US005451973A

United States Patent [19]

Walter et al.

[11] Patent Number: 5,451,973

[45] Date of Patent: Sep. 19, 1995

[54] MULTI-MODE DUAL CIRCULARLY POLARIZED SPIRAL ANTENNA

[75] Inventors: Carlton H. Walter; Donn V. D. Campbell, both of Poway, Calif.

[73] Assignee: TRW Inc., Redondo Beach, Calif.

[21] Appl. No.: 146,556

[22] Filed: Nov. 2, 1993

[51] Int. Cl.[6] ..... H01Q 1/36

[52] U.S. Cl. ..... 343/895; 343/789

[58] Field of Search ..... 343/895, 853, 789; H01Q 1/36

[56] References Cited

U.S. PATENT DOCUMENTS

| | | | |
|---|---|---|---|
| 3,681,772 | 8/1972 | Ingerson | 343/895 |
| 3,828,351 | 8/1974 | Voronoff | 343/895 |
| 4,243,993 | 1/1981 | Lamberty et al. | 343/895 |
| 4,605,934 | 8/1986 | Andrews | 343/895 |
| 4,962,383 | 10/1990 | Tresselt | 343/853 |

*Primary Examiner*—Michael C. Wimer

[57] ABSTRACT

A spiral antenna is provided which is capable of providing dual circular polarization operation with a large number of operating modes. The spiral antenna includes at least eight conductive spiral antenna arms extending outward about an axis of rotation. Each antenna arm has an inner end and an outer extending end and a plurality of arm width modulations formed therebetween for achieving dual circular polarization operation capability. Electrical feeds are coupled to the inner end of each of the spiral antenna arms. A feed network may be further connected to the electrical feeds for providing predetermined phase excitations to the corresponding spiral antenna arms so as to achieve the desired operating modes.

19 Claims, 8 Drawing Sheets

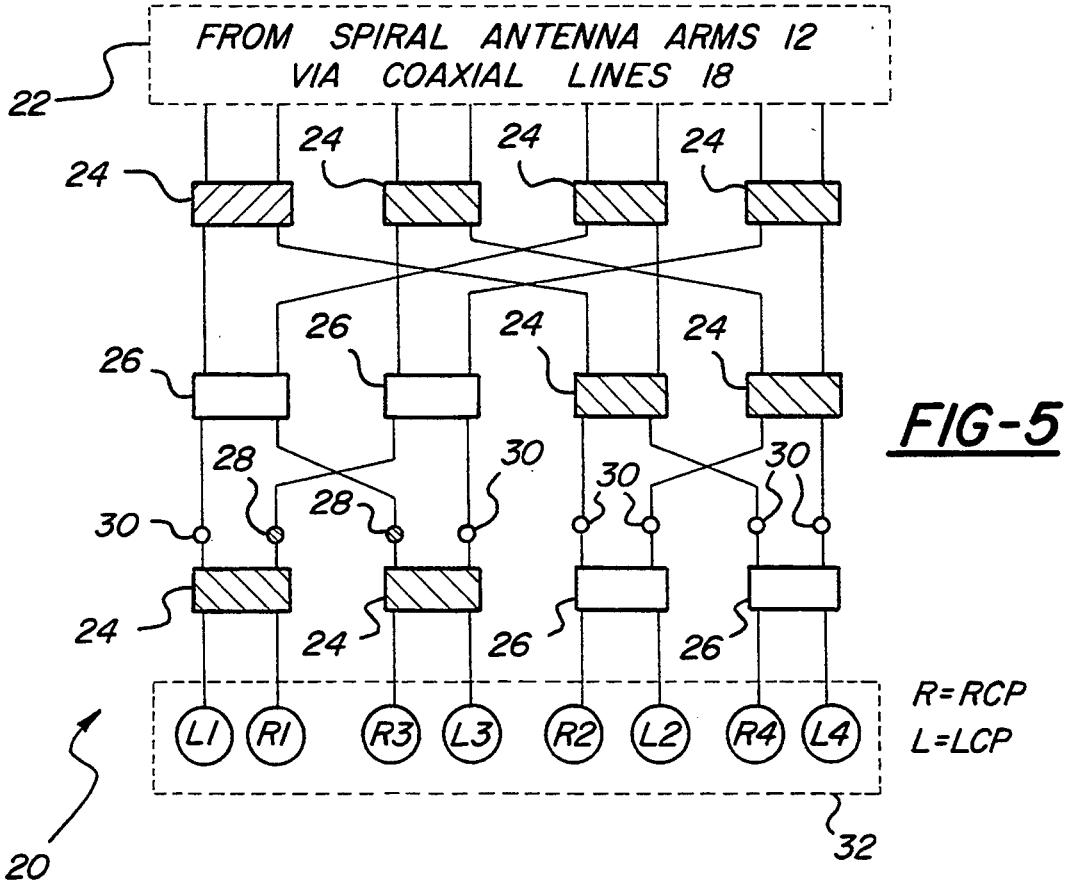
FIG-5
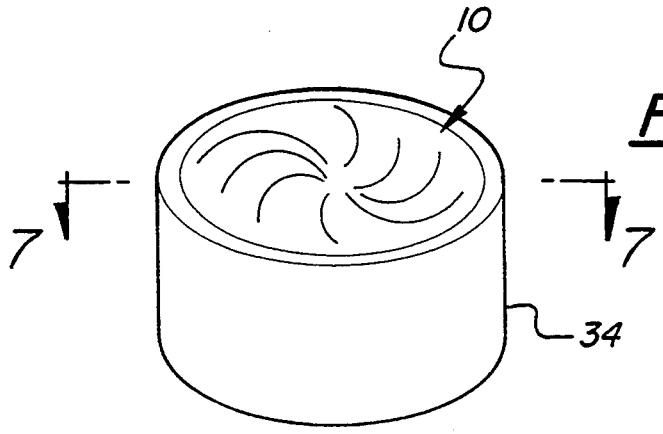
FIG-6
FIG-7
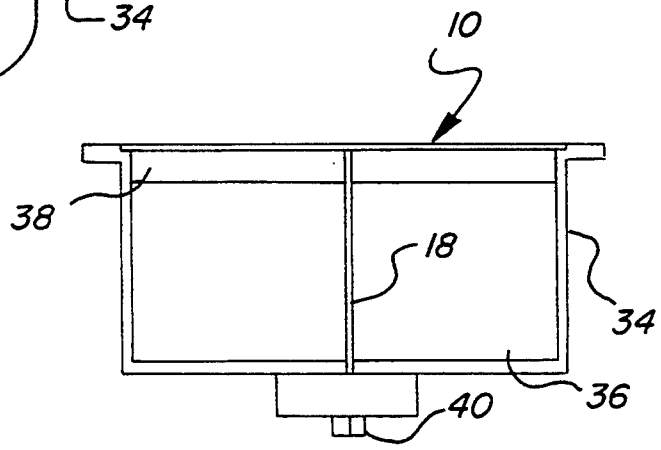

MULTI-MODE DUAL CIRCULARLY POLARIZED SPIRAL ANTENNA

BACKGROUND OF THE INVENTION

1. Technical Field

This invention relates generally to spiral antennas and, more particularly, to a multi-arm spiral antenna that is capable of providing both right and left hand circular polarized energy for a large number of operating modes.

2. Discussion

Spiral antennas are generally well known for providing constant directivity gain, beamwidth and impedance over broad frequency ranges and are particularly advantageous for operating at circular polarization. In the past, spiral antennas were commonly employed to transmit and/or receive electromagnetic energy having either a right-hand circular polarization or a left-hand circular polarization, in addition to detecting some linear polarized energy. For instance, a conventional center-fed multi-arm spiral antenna generally included conductive spiral arms wound in the counterclockwise direction which in turn would detect right-hand circular polarization, while spiral antennas having spiral arms wound in the clockwise direction would generally detect left-hand circular polarization. However, such single sense circular polarized spiral antennas generally are not capable of detecting both right-hand and left-hand circular polarization and therefore remain blind to electromagnetic waves of the opposite circular polarization.

One solution for achieving dual circular polarization operation is to provide separate left-hand circular polarization and right-hand circular polarization spiral antennas. However, the use of two separate oppositely polarized spiral antennas generally would amount to duplicate antenna components which in turn leads to increased cost and additional space requirements.

Another technique that has been employed to configure spiral antennas for operation with both right-hand and left-hand circular polarization is described in U.S. Pat. No. 3,681,772 issued to Ingerson. The aforementioned patent issued to Ingerson is incorporated herein by reference. According to the Ingerson approach, a center-fed modulated arm width spiral antenna is provided which comprises a series of cells formed by one section of antenna arm having a first relatively narrow width dimension followed by a second section of antenna arm of substantially greater width dimension. These cell sections form arm width modulations which are positioned along the antenna arms to establish impedance discontinuities or reflection regions which are intended to selectively reflect the outwardly flowing currents to produce reflected currents corresponding to the opposite sense of circular polarization. Thus, operation is achieved for both left-hand and right-hand circular polarization by establishing the proper arm width modulations.

However, the modulation approach described in U.S. Pat. No. 3,681,772 discloses a four-arm spiral antenna for providing up to two or possibly three modes of operation. Currently, there is an increasing need to achieve a larger number of modes of operation with spiral antennas which would provide increased accuracy angle-of-arrival information. An increased number of modes would advantageously increase the gain at small elevation angles near the horizon (i.e., plane of the antenna). This increased gain is generally due to the high order mode capability which effectively concentrates radiation close to the horizon. A higher-order multi-mode spiral could therefore be used to advantageously offset gain degradation that may otherwise be associated with the particular location of the spiral antenna on an aircraft that may involve a compromise in the radiation patterns and gain exhibited thereby.

It is therefore desirable to provide for a multi-arm spiral antenna which is capable of providing simultaneous dual circular polarization with a relatively high number of operating modes. It is further desirable to provide for such a center-fed dual circular polarization spiral antenna which has at least eight spiral antenna arms for providing at least six modes of operation. In addition, it is desirable to provide for a multi-arm spiral antenna which advantageously exhibits enhanced beam radiation patterns for achieving increased angle-of-arrival accuracy. Furthermore, it is also desirable to provide for such a spiral antenna which exhibits a broad frequency band and offers the convenience of a single antenna package.

SUMMARY OF THE INVENTION

In accordance with the teachings of the present invention, a spiral antenna is provided which is capable of providing dual circular polarization operation with a large number of operating modes. The spiral antenna includes at least eight conductive spiral antenna arms extending outward about an axis of rotation. Each antenna arm has an inner end and an outer extending end and a plurality of arm width modulations formed therebetween for achieving dual circular polarization operation capability. Electrical feeds are coupled to the inner end of each of the spiral antenna arms. A feed network may be further coupled to the electrical feeds for providing predetermined phase excitations which correspond to the spiral arms associated therewith for forming the multiple modes.

BRIEF DESCRIPTION OF THE DRAWINGS

Other objects and advantages of the present invention will become apparent to those skilled in the art upon reading the following detailed description and upon reference to the drawings in which:

FIG. 5 is a circuit diagram of a Butler matrix feed network employed in conjunction with the eight arm spiral antenna according to the present invention;

FIG. 6 is a schematic representation of the spiral antenna mounted in a cavity-backed housing;

FIG. 7 is a cross-sectional view of the cavity-backed spiral antenna shown in FIG. 6 taken through a central portion thereof along lines 7—7;

DETAILED DESCRIPTION OF THE PREFERRED EMBODIMENTS

Figure 1:
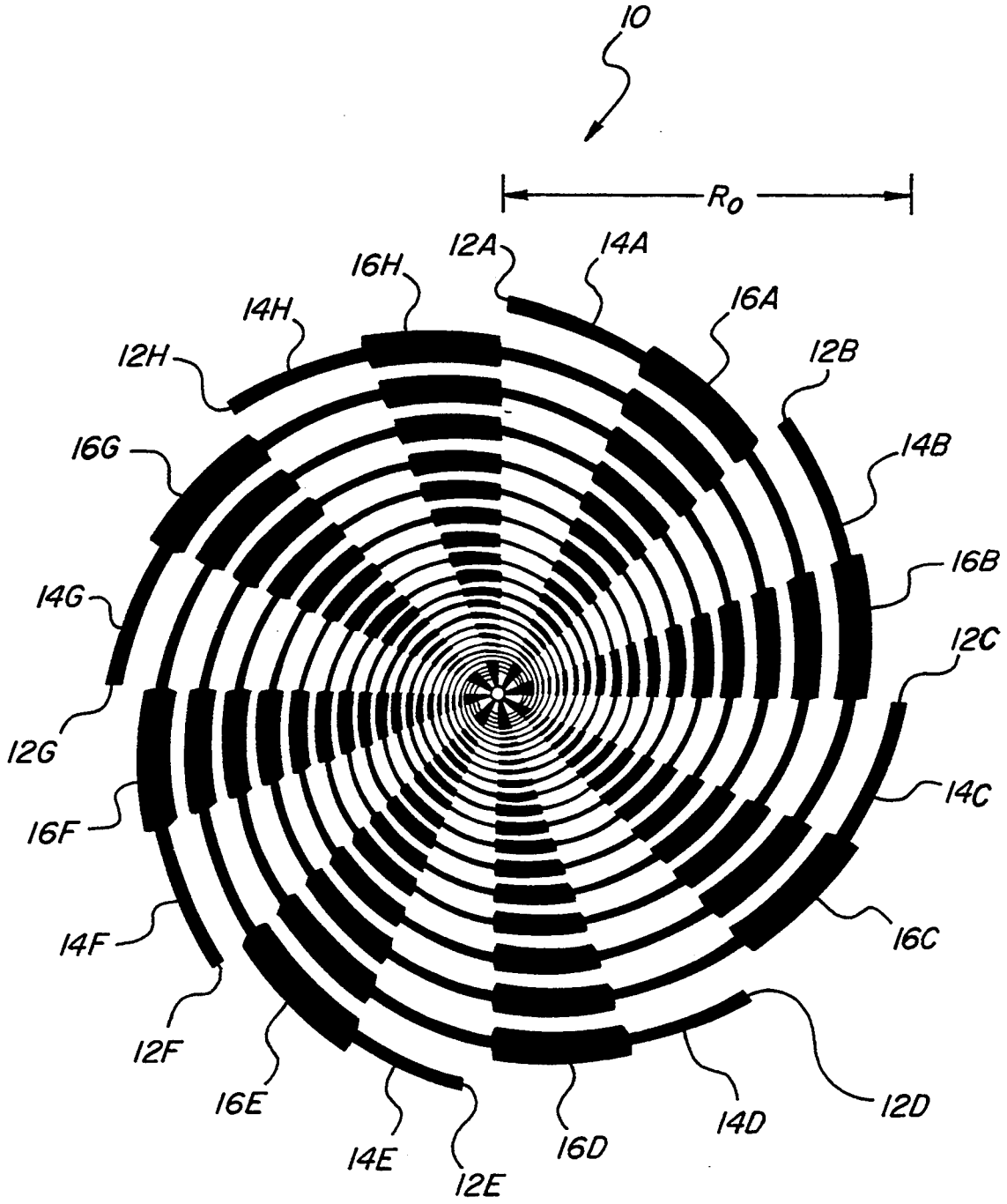
FIG. 1 is a plan view of an eight arm multi-mode spiral antenna with an exponential outer increasing arm width design in accordance with one embodiment of the present invention.
Figure 2:
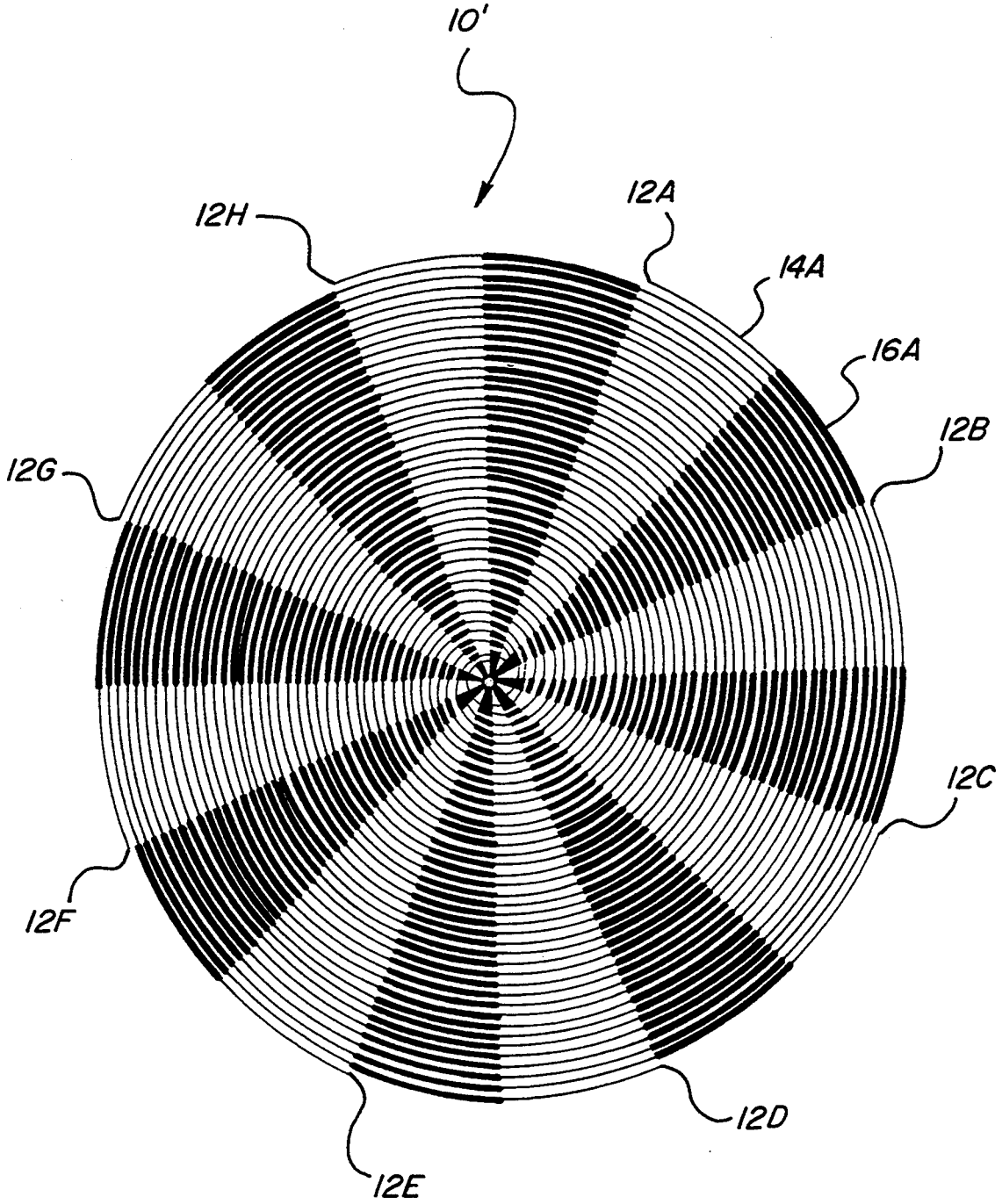
FIG. 2 is a plan view of an eight arm multi-mode spiral antenna with a constant archimedean arm width design in accordance with a second embodiment of the present invention.

Turning now to FIGS. 1 and 2, two embodiments of an eight-arm spiral antenna 10 and 10' are illustrated therein in accordance with the present invention. The invention is generally directed to a center-fed spiral antenna 10 which has a large number of spiral antenna arms formed with modulations which may achieve dual circular polarization. The present invention further provides for an increased number of operating modes. As will be described hereinafter, these operating modes may enable a user to obtain increased accuracy angle-of-arrival information despite the positioning of the antenna 10, among other advantages.

The eight arm spiral antenna 10 includes eight conductive spiral antenna arms 12A through 12H arranged in a spiral configuration and uniformly separated from one another. Each of spiral antenna arms 12A through 12H has an inner end located within a center feed region and extends outward about a common axis of rotation through a minimum of at least one and a half to two turns. Each of spiral antenna arms 12A through 12H terminates at an outer end. Spiral antenna 10 may have N equiangular spiral arms 12A through 12N which are consecutively rotated by 360°/N between adjacent arms. Accordingly, the eight arm spiral antenna 10 has adjacent arm separations of forty-five degrees (45°).

The spiral antenna arms 12A through 12H are made of an electrically conductive material such as copper etched on an electrically non-conductive planar substrate in a circular planar array. A planar substrate base advantageously allows for a low-profile planar configuration. However, the spiral antenna arms could likewise be formed with a conical, dome-shape or other kinds of configurations which may be suitable for the antenna location.

Each of the spiral antenna arms 12A through 12H has equiangular modulated arm widths which include alternately located narrow sections 14A through 14H and substantially wider sections 16A through 16H. The present invention employs a preferred wide section to narrow section width ratio of four or greater. Practically speaking, an arm width ratio of approximately between four and twelve will suffice for most applications. However, due to the limited space available in the vicinity of the inner regions of antenna 10, it is generally necessary to employ a relatively small width ratio of say four near the inner end of the spiral arms 12A through 12H and expand to a larger width ratio of say ten near the outer ends. This allows one to achieve a suitable spacing between spiral arms 12A through 12H in the central portion of antenna 10.

An N arm spiral antenna employs N evenly spaced arm width modulations per each revolution. Accordingly, an eight arm antenna 10 includes eight modulations with eight 22½° narrow width sections 14A through 14H and eight 22½° wide width sections 16A through 16H per each turn. It is the arm width modulations which cause antenna 10 to respond to both right-hand and left-hand circular polarization. In addition, spiral antenna 10 is also responsive to linear polarization and elliptical polarization. The periodic variations in conductor width (i.e., arm width modulations) form periodic regions along the spiral arms such that essentially all of the incident energy present along the arms is reflected by the arm impedance mismatch that is caused by the modulated width variations.

With particular reference to FIG. 1, the eight arm spiral antenna 10 is shown with an exponential outer increasing arm width according to one embodiment of the present invention. The width of each of the spiral antenna arms 12A through 12H increases in size the further the distance from the center region of the antenna 10. The arm width may increase in size as a linear or exponential function of distance. In effect, the increasing arm width advantageously provides enhanced beam radiation efficiency.

In accordance with a second embodiment, the spiral antenna 10' may include constant arm width sections as shown in FIG. 2. This is known as an archimedean antenna design in which the narrow width sections 14A through 14H have substantially equal width, while the wide arm sections 16A through 26H likewise have substantially equal width. Alternately, the increasing width and constant width embodiments of the spiral antennas 10 and 10' may be combined to provide for a compound antenna design without departing from the spirit of this invention. For instance, one may employ the increasing width spiral arm antenna 10 for the inner arm portion of the spiral antenna while turning to a constant width spiral arm antenna 10' to form the outer portions thereof. In addition, tapered outer ends may be employed to further modify the radiation beam patterns among other advantages.

Figure 3:
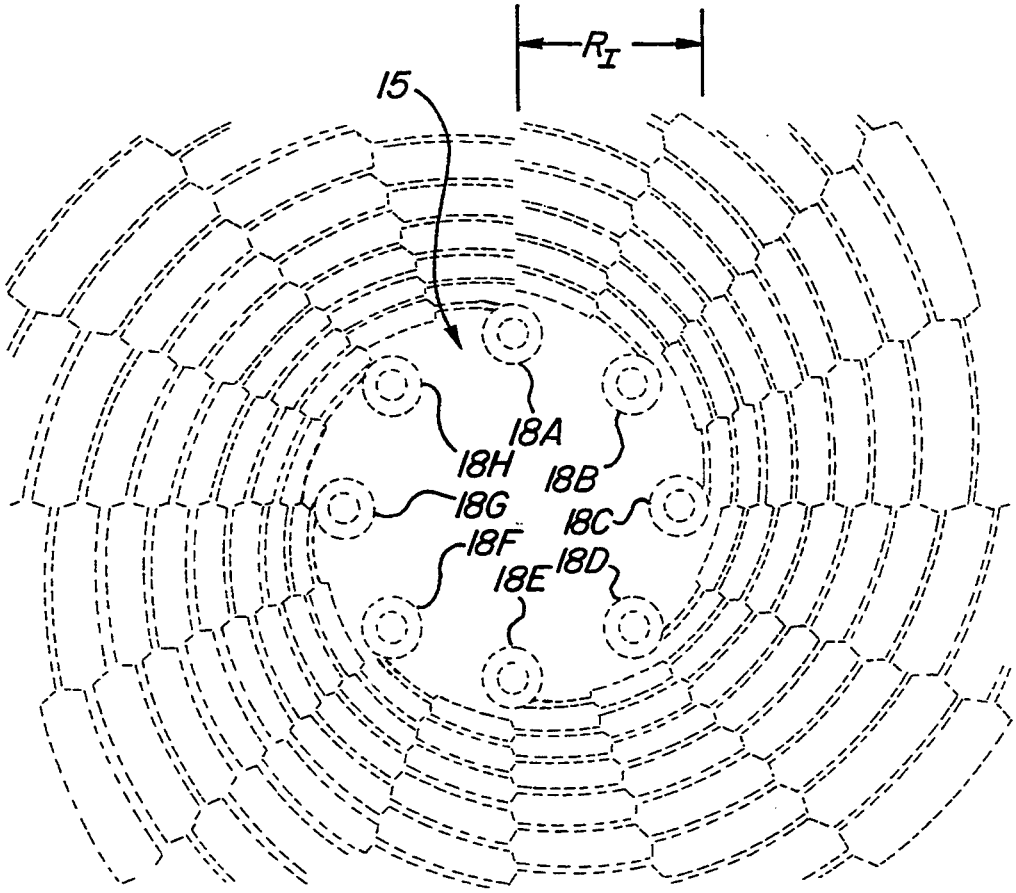
FIG. 3 is an enlarged plan view of the center feed portion of the eight arm spiral antenna as shown in FIG. 1.
Figure 4:
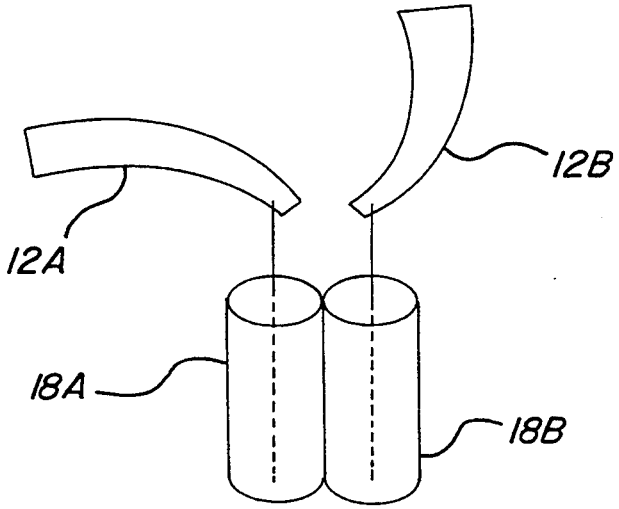
FIG. 4 is a schematic representation of a pair of spiral arm-to-coaxial transmission line connections.
Figure 8A:
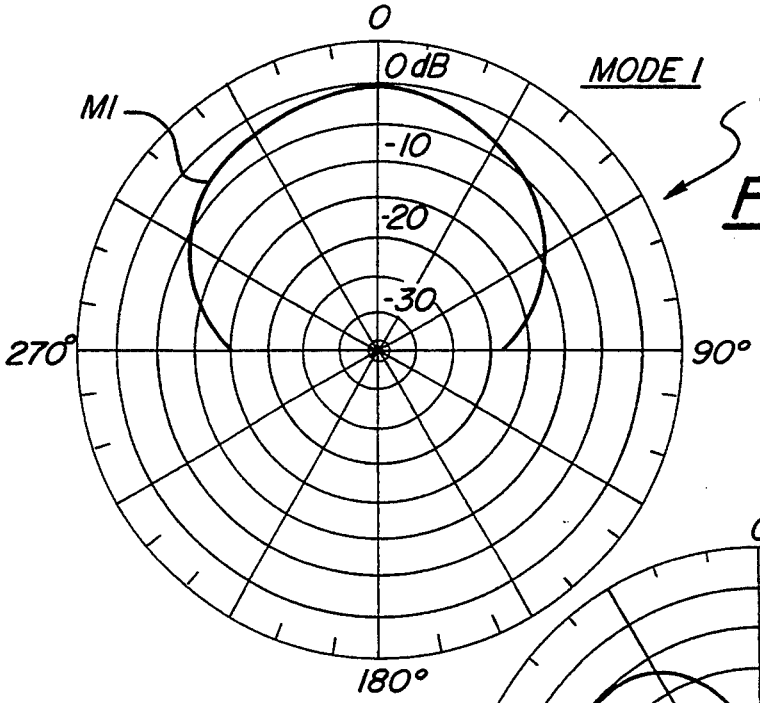
FIGS. 8A through 8F are graphical representations which illustrate elevation plane beam patterns for six multiple modes achieved with one example of the eight arm multi-mode dual circular polarization spiral antenna.
Figure 8B:
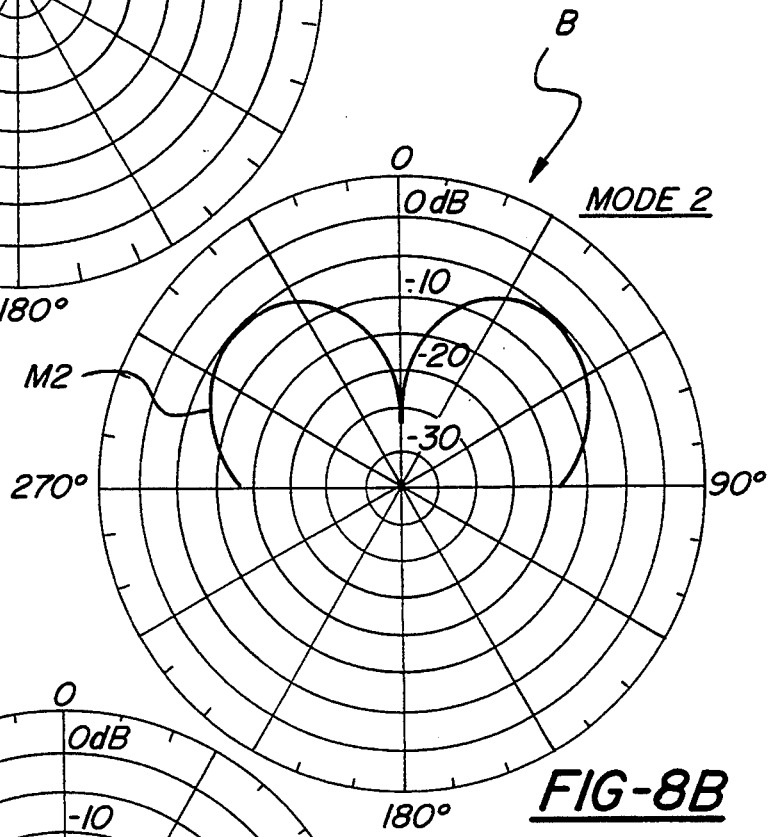
Figure 8C:
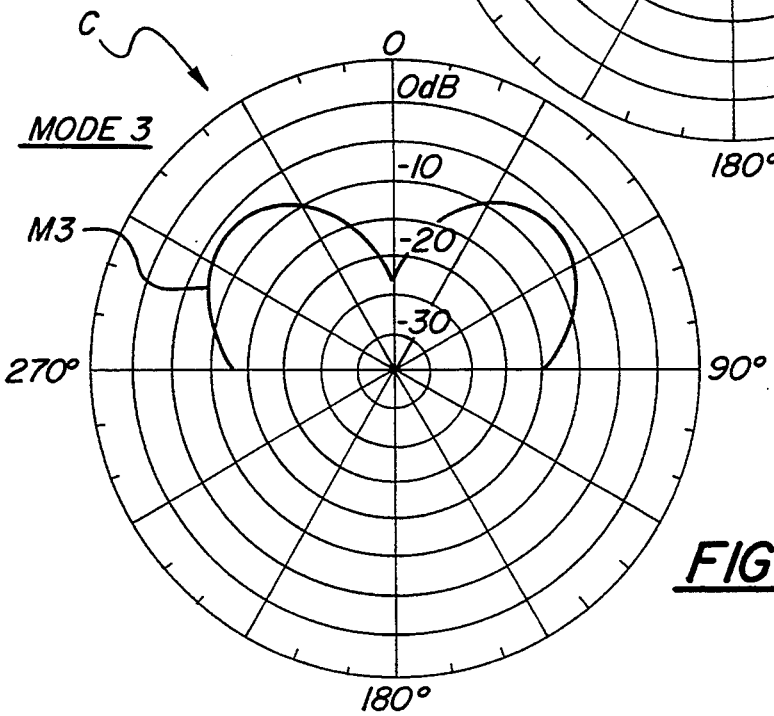
Figure 8D:
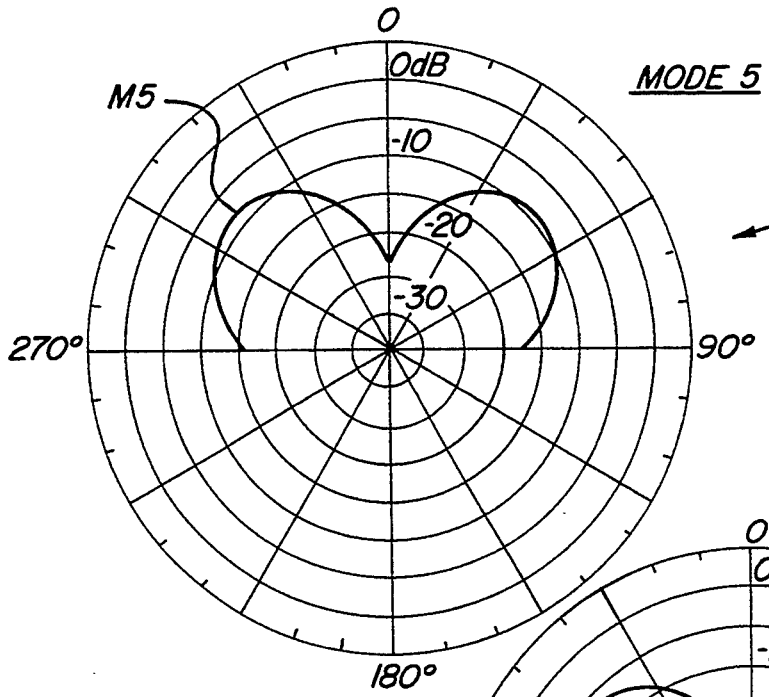
Figure 8E:
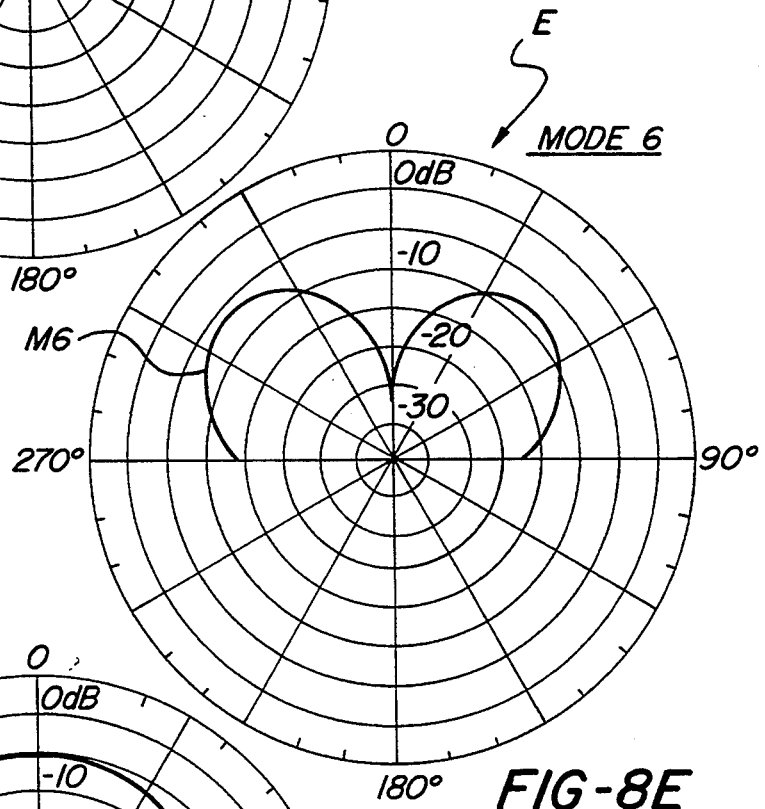
Figure 8F:
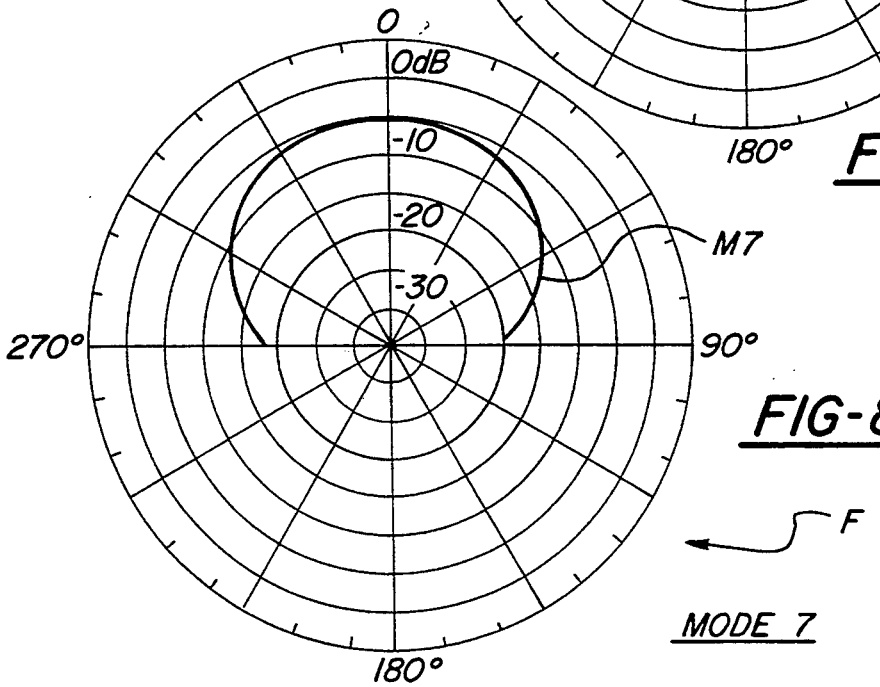
Figure 9A:
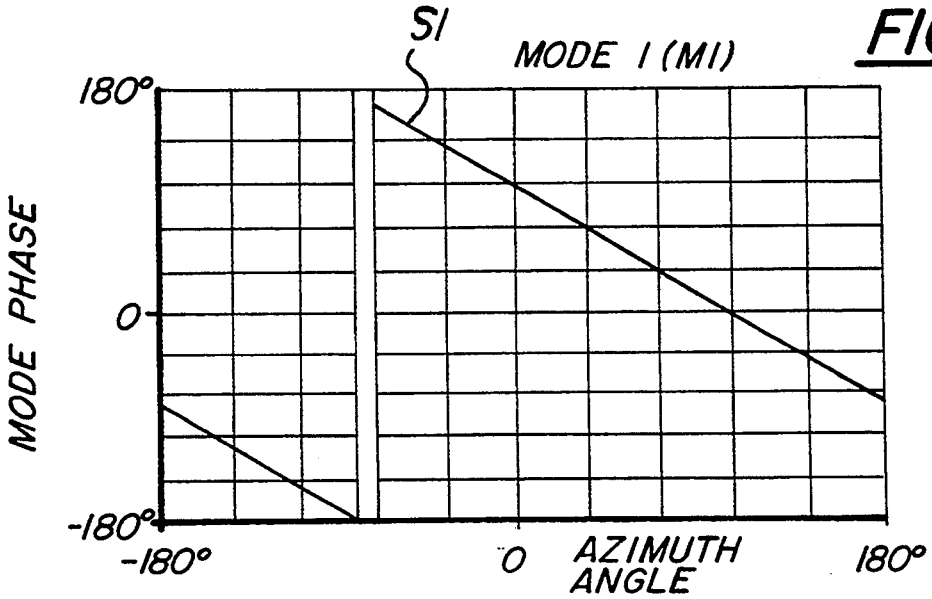
FIGS. 9A through 9F are graphical representations which illustrate measured azimuthal phase patterns for six modes achieved with one example of the eight arm spiral antenna.
Figure 9B:
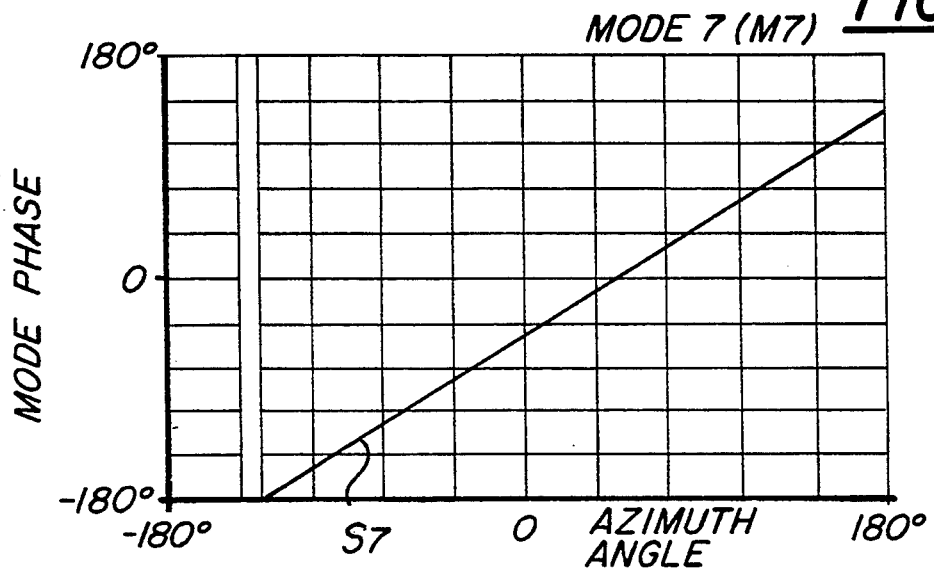
Figure 9C:
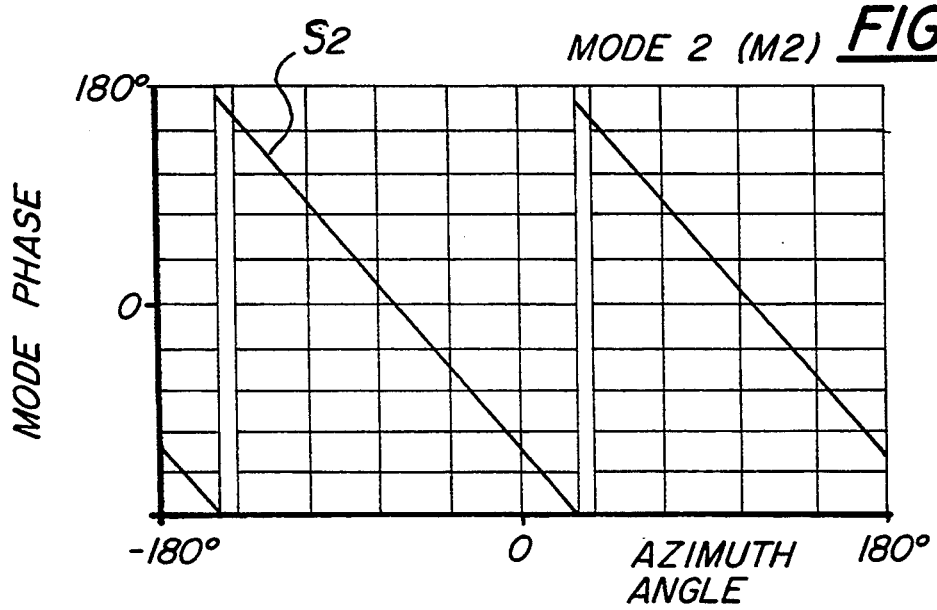
Figure 9D:
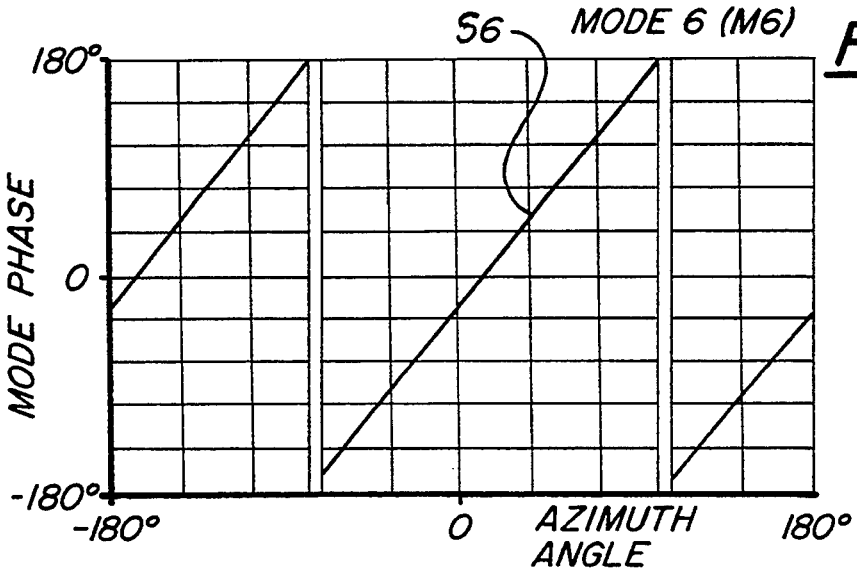
Figure 9E:
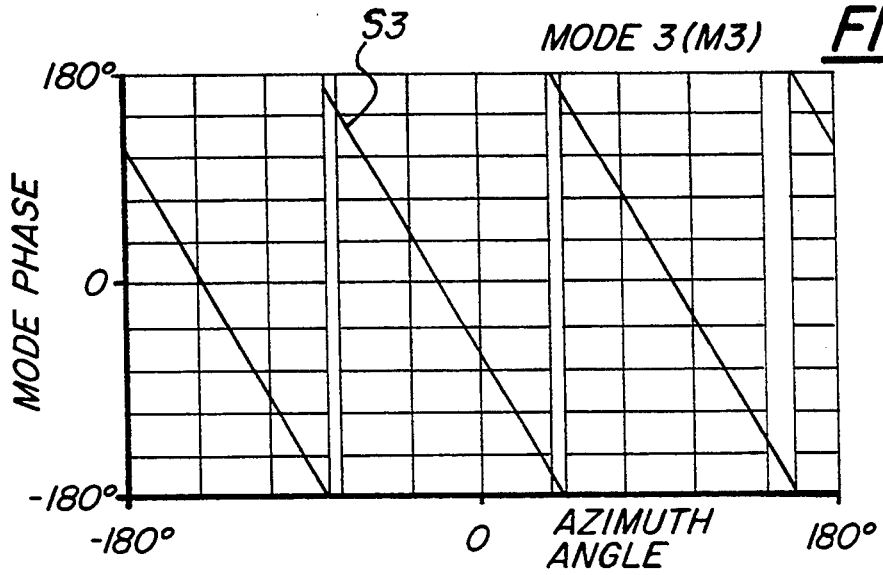
Figure 9F:
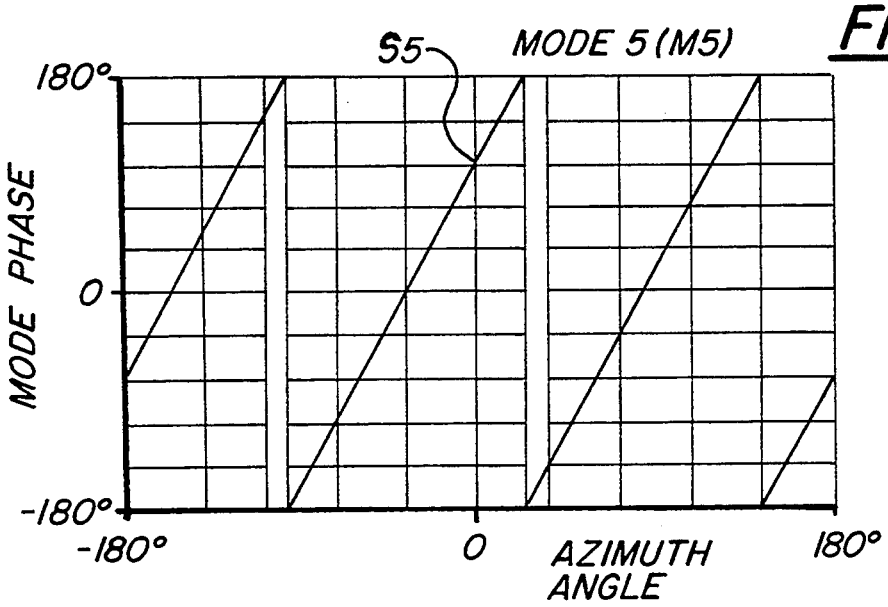

The central portion of the spiral antenna 10 is illustrated in FIG. 3. The spiral antenna 10 has a center feed region 15 in which electrical feed connections are provided to the center-fed spiral antenna 10. Included in the center feed region 15 are eight miniature coaxial transmission lines 18A through 18H which are electrically coupled to the inner ends of spiral arms 12A through 12H. A pair of adjacent spiral arm-to-coaxial transmission line connections are illustrated in detail in FIG. 4. The inner end of spiral antenna arm 12A is electrically connected to the inner conductor of coaxial transmission line 18A. Likewise, the inner end of spiral antenna arm 12B is electrically connected to the inner conductor of coaxial transmission line 18B. In accordance with the well known use of coaxial transmission lines, an outer conductor forms an outer conductive surface which isolates the inner conductors thereof from external interference. The remaining spiral arms 12C through 12H are likewise connected to associated coaxial transmission lines 18C through 18H in a like manner.

The overall physical dimensions of spiral antenna 10 such as the inner radius $R_I$ and outer radius $R_o$ of the antenna aperture are preferably selected based in part upon the operating frequency range as well as the number of operating modes. The feed region 15 has a radius $R_I$ that is equal to or less than one-quarter wavelength at the highest operating frequency. On the other hand, the overall outer aperture radius $R_o$ of spiral antenna 10 is selected based on a combination of the number of operating modes and the lowest operating frequency. More specifically, the lowest operating frequency is determined by the outer radius $R_o$ and is generally equal to about one-quarter wavelength at the lowest operating frequency for a mode one M1 operation. However, for multi-mode operations, the spiral antenna outer radius $R_o$ is increased to accommodate such additional modes. The outer radius $R_o$ may be defined as follows:

$$R_o(m)=(m/2\pi)\lambda_o(\lambda/\lambda_o)$$

where m is the mode number and $\lambda_o$ and $\lambda$ define the respective vacuum wavelength and aperture wavelength for the lowest operating frequency. Practically speaking, a spiral antenna etched on a low permittivity substrate material may achieve a wavelength reduction factor ratio of $\lambda/\lambda_o$ on the order of 0.8. Ratios of 0.5 or better can be achieved with higher permittivity substrates. In addition, the spiral antenna 10 can be scaled in size to operate at selected frequencies which are consistent with the size constraints.

In addition, the radiation zones of the spiral antenna 10 may be further characterized by what is commonly known as the active antenna region. The active region of a spiral antenna is generally known as the radius at which radiation emanates from the antenna aperture. A mode one M1 active region may be defined by the radius on the spiral antenna 10 where the circumference of the spiral antenna is equal in length to approximately one wavelength of the operating signal. Similarly, the active regions for modes two M2 and three M3 are defined by the radius where the circumference corresponds in length to approximately two and three wavelengths, respectively. For example, in order to accommodate up to modes ±M3 at a frequency of two gigahertz (2 GHz.) with a vacuum wavelength of about 5.9 inches, the spiral antenna aperture circumference should be about three Wavelengths and the diameter should be about one wavelength. One may employ a more conservative design approach with an aperture diameter of approximately two wavelengths. Assuming a wavelength reduction factor ratio of $\lambda/\lambda_o=0.8$, the antenna aperture for the above-described example should be at least ten inches in diameter in order to support ±M3 mode operations at a frequency of two gigahertz.

The coaxial transmission lines 18A through 18H are further connected to a feed network 20 via a connector 22 as shown in FIG. 52 The feed network 20 preferably includes a Butler matrix feed which is made up of a plurality of one hundred eighty degree (180°) hybrid couplers 24, ninety degree (90°) hybrid couplers 26, forty-five degree (45°) fixed phase shifters 28 and reference lines 30. Feed network 20 has eight feed ports L1 through L4 and R1 through R4 for providing left-hand and right-hand circular polarization signal excitations.

The operating mode of the spiral antenna 10 is established by phase progression achieved with the feed network 20. For instance, modes ±M1 which represents mode one M1 for right-hand and left-hand circular polarization, respectively, are selected by exciting successive arms of the eight-arm spiral antenna 10 with the following forty-five degree shifted phases: 0, ±45, ±90, . . . ±315 degrees. The excitation phases for each of spiral arms 12A through 12H of the eight arm spiral antenna for achieving modes ±M1, ±M2 and ±M3 are shown in the following table:

| | EXCITATION PHASE DEGREES | | | | | | | |
|---|---|---|---|---|---|---|---|---|
| MODE | 1 | 2 | 3 | 4 | 5 | 6 | 7 | 8 |
| M1 | 0° | 45° | 90° | 135° | 180° | 225° | 270° | 315° |
| M2 | 0° | 90° | 180° | 270° | 0° | 90° | 180° | 270° |
| M3 | 0° | 135° | 270° | 45° | 180° | 315° | 90° | 225° |
| M5 = (−M3) | 0° | 225° | 90° | 315° | 180° | 45° | 270° | 135° |
| M6 = (−M2) | 0° | 270° | 180° | 90° | 0° | 270° | 180° | 90° |
| M7 = (−M1) | 0° | 315° | 270° | 225° | 180° | 135° | 90° | 45° |

The spiral antenna 10 may be installed on an absorber-loaded cavity assembly 34 as illustrated in FIGS. 6 and 7. The assembly 34 includes a cavity preferably with a foam or honeycomb dielectric absorber 36 and spacer 38 located therein. The transmission lines 18 extend through the cavity to an RF connector 40 for allowing external connection therewith. The cavity loading generally restricts beam radiation to the top surface of the antenna 10 so as to provide isolation on the bottom side thereof. This particular cavity arrangement is well suited for installation on the surface of an aircraft where isolation from the aircraft and electronics associated therewith may be desired.

In operation, the spiral antenna 10 may operate to transmit and/or receive simultaneous dual circular polarization energy with a large number of operating modes. More specifically, an N arm spiral antenna may provide at least N-2 operating modes. Therefore, the eight arm spiral antenna 10 produces six operating modes M1 through M3 and M5 through M7. An additional mode M4 may also be achieved but is generally not employed herein. During operation, the center-fed spiral arms 12A through 12H communicate with the feed network 20 via coaxial transmission lines 18A through 18H. Feed network 20 provides a combination of eight output signals that represent phase shifted signals which in turn may be used to establish desired operating modes.

FIGS. 8A through 8F illustrate measured elevation plane gain patterns achieved with one example of the eight-arm spiral antenna 10 at a frequency of two gigahertz. Modes M1, M2 and M3 represent right-hand circular polarization, while modes M5, M6 and M7 represent left-hand circular polarization. As supported by the graphs, mode M7 is substantially equal in gain to mode −M1, while modes M6 and M5 are substantially equal in gain to modes −M2 and −M3, respectively. Modes M1 and M7 provide substantially uniform omnidirectional gain patterns. However, the additional modes M2, M3, M5 and M6 provide enhanced wide angle beam coverage. That is, the large number of operating modes enables the spiral antenna 10 to achieve a wide coverage which extends along the horizon of the planar antenna. Such a beam pattern enables a user to employ spiral antenna 10 without regard to stringent antenna orientation requirement.

Azimuthal phase patterns for right-hand and left-hand circular polarization modes are provided in FIGS. 9A through 9F. Phase patterns for modes M1 and M7 exhibit substantially the same linear but opposite slope S1 and S7. Likewise, modes M2 and M6 exhibit substantially the same but opposite slope S2 and S6, while modes M3 and M5 have corresponding opposite slope S3 and S5 phase patterns.

The present invention has particularly been described herein in connection with the eight arm spiral antenna 10. However, the present invention generally applies to spiral antennas preferably having at least eight or more spiral antenna arms for producing at least six or more operating modes. For instance, a twelve arm spiral antenna could be provided in accordance with the teaching of the present invention with at least ten operating modes. However, one should understand that a more complex feed system may be required to provide the necessary excitation to any additional spiral arms. In addition, one may also apply the teachings of the present invention to achieve a six arm spiral antenna with at least four modes of operation.

In view of the foregoing, it can be appreciated that the present invention enables the user to achieve a multi-mode spiral antenna which provides dual circular polarization capability. Thus, while this invention has been disclosed herein in connection with a particular example thereof, no limitation is intended thereby except as defined in the following claims. This is because a skilled practitioner recognizes that other modifications can be made without departing from the spirit of this invention after studying the specification and drawings.

What is claimed is:

1. A dual circular polarization spiral antenna which is capable of providing multiple modes of operation comprising:

a plurality of conductive spiral antenna arms extending outward about an axis of rotation, each antenna arm having an inner end and an outer end and arm width modulations, said arm width modulations including alternately located wide sections and narrow sections for reflecting electromagnetic energy so as to enable radiation and detection of dual circular polarization, wherein a width ratio of said wide sections to said narrow sections increases from said inner end of each of said spiral antenna arms as said spiral antenna arms extend outward about said axis of rotation and said wide sections have a width of greater than four times the width of said narrow sections; and feed means coupled to the inner end of each of said spiral antenna arms for providing predetermined phase excitations to achieve selected operating modes.

2. The antenna as defined in claim 1 wherein said plurality of conductive spiral antenna arms comprises at least eight conductive spiral antenna arms.

3. The antenna as defined in claim 1 wherein said antenna is adapted to provide N−2 modes, where N equals the number of conductive spiral antenna arms.

4. The antenna as defined in claim 1 wherein said antenna has a number of arm width modulations per revolution equal to the number of conductive spiral antenna arms.

5. The antenna as defined in claim 1 wherein said feed means comprise a Butler matrix feed network.

6. The antenna as defined in claim 5 wherein said feed means further comprises a plurality of coaxial connectors each coupled to the inner end of said antenna arms providing a transmission path between said spiral arms and said feed network.

7. The antenna as defined in claim 2 wherein said spiral arms, are formed within an antenna aperture which has an outer radius that allows for said antenna to provide at least six operating modes.

8. A multi-mode spiral antenna which is capable of handling dual circular polarization comprising:

at least eight conductive spiral antenna arms extending outward about an axis of rotation, each antenna arm having an inner end and an outer end with a plurality of arm width modulations, said arm width modulations including alternately located wide sections and narrow sections for reflecting electromagnetic energy so as to enable radiation and detection of at least three modes of left-hand circular polarization and at least three modes of right-hand circular polarization, wherein a width ratio of said wide sections to said narrow sections increases from said inner end of each of said spiral antenna arms as said spiral antenna arms extend outward about said axis of rotation; and feed means coupled to the inner end of each of said spiral antenna arms for providing predetermined phase excitations in order to adapt said multi-mode spiral antenna for providing at least six selected operating modes.

9. The antenna as defined in claim 8 wherein each of said wide sections has a width of greater than four times the width of said narrow sections.

10. The antenna as defined in claim 9 wherein said antenna has a number of arm width modulations per revolution equal to the number of conductive spiral antenna arms.

11. The antenna as defined in claim 8 wherein said feed means comprise a Butler matrix feed-network for obtaining arm phasing for mode generation.

12. A method for providing a multi-mode dual circular polarization spiral antenna comprising:

forming an array of at least eight conductive spiral antenna arms in a spiral pattern about an axis of rotation, each arm having an inner end and an outer end;

forming modulations in each of said spiral antenna arms so as to provide for alternatively located first and second segments including the step of increasing a ratio of width of said second segments to said first segments as each of said spiral antenna arms extends outward about said axis of rotation, and wherein said ratio increases so that said second segments have a conductive width of at least four times the width of said first segments; and coupling the inner end of each of said conductive spiral antenna arms to a feed network that is adapted to provide phase excitations for achieving at least six operating modes.

13. The method as defined in claim 12 further comprising the step of coupling said feed network to said spiral antenna arms via a plurality of coaxial transmission lines.

14. The method as defined in claim 12 further comprising the step of forming said spiral antenna arms within an antenna aperture having an outer radius that is large enough to allow for broadband multi-mode operations.

15. The method as defined in claim 12 wherein said feed network comprises a Butler matrix feed network.

16. A dual circular polarization spiral antenna which is capable of providing multiple modes of operation comprising:

a plurality of conductive spiral antenna arms extending outward about an axis of rotation, each antenna arm having an inner end and an outer end and arm width modulations, said arm width modulations including alternately located wide sections and narrow sections for reflecting electromagnetic energy so as to enable radiation and detection of dual circular polarization, wherein a ratio of width of said wide sections to said narrow sections increases from the inner end of each of said spiral antenna arms as said spiral antenna arms extend outward about said axis of rotation; and feed means coupled to said inner end of each of said spiral antenna arms adapted to provide predetermined phase excitations to achieve selected operating modes.

17. The antenna as defined in claim 16 wherein said plurality of conductive spiral antenna arms comprises at least eight conductive spiral antenna arms adapted to provide for at least six operating modes.

18. The antenna as defined in claim 16 wherein said antenna has a number of arm width modulations per revolution equal to the number of conductive spiral antenna arms.

19. The antenna as defined in claim 16 wherein each of said wide sections has a width of greater than four times the width of said narrow sections.

* * * * *